United States Patent [19]

Ambier et al.

[11] Patent Number: 4,919,717

[45] Date of Patent: Apr. 24, 1990

[54] SINTERED COMPOSITE MATERIAL FOR ELECTRICAL CONTACT

[75] Inventors: Jean Ambier, Grenoble; Marie-Jo Francillon; Colette Allibert, both of St. Martin D'Heres; Catherine Laugee, Paris, all of France

[73] Assignee: Merlin Gerin, France

[21] Appl. No.: 185,980

[22] Filed: Apr. 25, 1988

[30] Foreign Application Priority Data

May 4, 1987 [FR] France ..... 87 06286

[51] Int. Cl.[5] ..... B22F 7/00

[52] U.S. Cl. ..... 75/228; 75/243; 75/247; 419/23; 428/675

[58] Field of Search ..... 75/228, 243, 247; 419/23; 428/675

[56] References Cited

U.S. PATENT DOCUMENTS 4,498,395 2/1985 Kock et al. ..... 102/517
4,622,269 11/1986 Leung et al. ..... 428/550

FOREIGN PATENT DOCUMENTS 0171339 12/1986 European Pat. Off. .
2115865 7/1972 France .
2247544 9/1975 France .
1000651 8/1965 United Kingdom .

OTHER PUBLICATIONS

F. V. Lenel, Powder Metallurgy Principles and Applications, Apr. 1980, pp. 33–44.

*Primary Examiner*—Stephen J. Lechert Jr.
*Assistant Examiner*—Ngoclan Mai
*Attorney, Agent, or Firm*—Arnold, White & Durkee

[57] ABSTRACT

Sintered composite material containing 80% to 95% weight of copper, 2% to 15% weight of nickel and 2% to 5% weight of graphite, designed for the manufacture of electrical contact pads for low voltage switchgear devices. The copper powder can be of a spongy form having an average diameter of less than 24 μm, an oxygen content of lower than 2000 ppm and a purity in metallic elements of 99.5%. The graphite powder can be of pellicular form, having particles about 100 μm in length and 20 μm in thickness, and an ash content of less than 0.2 ppm. The nickel powder can be of a spheroid shape having an average diameter of less than 5 μm.

3 Claims, No Drawings

SINTERED COMPOSITE MATERIAL FOR ELECTRICAL CONTACT

BACKGROUND OF THE INVENTION

The present invention relates to a sintered copper-based composite material designed to be used to form electrical contacts.

Conventional contact materials used today in low voltage switchgear devices, circuit breakers, contactors or switches, contain from 60 to 95% of silver in order to obtain the required performances. But silver is an expensive material.

SUMMARY OF THE INVENTION

The object of the present invention is to achieve a cheaper contact material than conventional materials and which nevertheless presents good characteristics as far as electrical and thermal conductivity is concerned, a high resistance to oxidation and erosion, a low contact resistance and a low welding tendency.

The material according to the invention is characterized in that it contains 80 to 95% weight of copper, 2 to 15% weight of nickel and 2 to 5% weight of graphite This copper-based material, containing particles of graphite and nickel, is cheaper than silver and presents good electrical and thermal characteristics.

Copper is used essentially because of its low cost and its good electrical and thermal conductivity.

The graphite in conjunction with the copper forms a composite material which has a low mechanical resistance, thus minimizing welding forces. In addition, in the presence of an arc, the graphite combines with oxygen, of the air or of the material, to form carbon dioxide, thus limiting the formation of copper oxide. It is nevertheless necessary to limit the graphite content of the material to avoid excess erosion of the latter in the presence of an electric arc.

As for the nickel, it contributes, when cold, to reducing the oxidation rate of copper and it forms with the copper an alloy having good mechanical resistance. The introduction of nickel provides a very acceptable compromise between a low contact resistance, therefore a low heat rise, a moderate erosion and a minimum welding risk. However, as the copper-nickel alloy has a higher resistivity than that of copper, the nickel content cannot exceed a certain value.

The material according to the invention is produced by the powder metallurgy technique. The powders used are preferably selected from the point of the view of their granulometry and of their metallic or gaseous purity. Copper powder of spongy form is preferably used, having an average diameter of less than 24 μm, an oxygen content lower than 2000 ppm and a purity of 99.5% in metallic elements. Graphite powder of pellicular form is preferably used with elements approximately 100 μm in length and 20 μm n thickness, and whose ash content is less than 0.2 ppm. The purity of the graphite enables the properties of the material to be improved. The nickel powder is spheroid in shape and has an average diameter of less than 5 μm.

The powder mixture selected is homogenized in conventional grinding mills for about 4 hours, and is then made into the form of pellets by unitary compression, under a pressure of between 1 and 5 t/sq.cm. The pellets are then sintered in furnaces in a controlled atmosphere containing from 3 to 100% of hydrogen, from 0 to 5% of carbon dioxide gas and from 0 to 92% of nitrogen, for times ranging from 30 minutes to 2 hours according to the size of the parts. The sintering temperature can vary from 970° to 1030° C.

In order to reduce the amount of porosity, recompression is applied to the material, followed by annealing eliminating the residual stresses. All these operations must be carried out so as to minimize the oxygen content included in the material, thus preventing excessive formation of copper oxide in the presence of an electric arc.

According to the invention, an electrical contact pad can be constituted by the composite material in the manner described above.

According to a preferred embodiment of the invention, this material can be used to form a contact pad made up of two superposed layers. The first layer, whose thickness is comprised between 0.1 and 0.5 mm, contains essentially copper, whereas the second layer is made up of the copper - nickel - carbon composite material described above. The presence of a first layer of copper enables the contact to be brazed onto copper conductor supports with a filling coefficient of between 70 and 90%. The two layers are then compressed simultaneously to form the contact pad which is then sintered, recompressed and annealed in the manner already described.

In order to understand the invention better, the latter is illustrated by the following examples, given as non-restrictive examples of concrete achievements.

EXAMPLE 1

A mixture of powders having the following composition was used to form the second layer:

copper:81%
nickel:15%
carbon:4%

This mixture was compressed, with a first layer of copper, under a pressure of approximately 4t/sq.cm for 20 seconds and the pellets were placed in a furnace containing 100% hydrogen for approximately 1 hour at 1000° C. The material was then recompressed under a pressure of approximately 10t/sq.cm for 20 seconds.

The material thus obtained was tested for electrical endurance on a testing machine performing 5000 openings under 100A (220V). Two electrical contacts each made of the material thus obtained were placed facing one another. The mean contact resistance was 1.3 mΩ, and the total erosion of the two contacts 160 mg. The oxygen content inside the material was about 140 ppm.

EXAMPLE 2

The following mixture was used under the same conditions to form the second layer:

copper:91%
nickel:5%
carbon:4%

The mean resistance was 0.92 mΩ, and the total erosion of two contacts was 230 mg.

EXAMPLE 3

A mixture of powders having the following composition was used to form the second layer:

copper:91%
nickel:5%
carbon:4%

This mixture was compressed, with a first layer of cooper, under a pressure of approximately 4t/sq.cm for 20 seconds and the pellets placed in a furnace containing hydrogenated nitrogen (3% hydrogen, 5% carbon dioxide gas, 92% nitrogen) for approximately 45 minutes at 980 C. The mixture was then recompressed under a pressure of approximately 10t/sq.cm for 20 seconds.

The material thus obtained was tested:

for electrical endurance on a testing machine performing 5000 openings under 100A (220V). Two electrical contacts each made of the material thus obtained were placed facing one another. The mean contact resistance was 1.05 mΩ and the total erosion 200 mg. The oxygen content inside the material was 340 ppm.

for very low voltage weldability on a 125 A device. The currents applied were 3, 5, 7 KA for 10, 30, 50 ms. The material presented only a very small tendency to welding.

for electrical endurance on 16 A miniature circuit breakers. the result of the test proved satisfactory.

The contact pads using the composite material according to the invention can be used in all low voltage switchgear devices, circuit breakers, contactors and switches.

We claim:

1. A sintered copper-based composite material for electrical contacts, comprising 80-95% by weight copper, 2-15% by weight nickel, and 2-5% by weight graphite, wherein said material is obtained from copper powder of a spongy form, said powder having an average diameter of less than 24μm, an oxygen content of lower than 2000 ppm and a purity in metallic elements of 99.5%.

2. A sintered copper-based composite material for electrical contacts, comprising 80-95% by weight copper, 2-15% by weight nickel, and 2-5% by weight graphite, wherein said material is obtained from graphite powder of pellicular form, said powder having particles which are approximately 100 μm in length and 20 μm in thickness, and having an ash content of less than 0.2 ppm.

3. A sintered copper-based composite material for electrical contacts, comprising 80–95% by weight copper, 2–15% by weight nickel, and 2–5% by weight graphite, wherein said material is obtained from nickel powder of a spheroid shape, said powder having an average diameter of less than 5 μm.

* * * * *